US008900105B2

(12) United States Patent
Zhu

(10) Patent No.: US 8,900,105 B2
(45) Date of Patent: Dec. 2, 2014

(54) SLIMMING MACHINE

(76) Inventor: Xiangjun Zhu, Yongkang (CN)

( * ) Notice: Subject to any disclaimer, the term of this patent is extended or adjusted under 35 U.S.C. 154(b) by 396 days.

(21) Appl. No.: 13/352,928

(22) Filed: Jan. 18, 2012

(65) Prior Publication Data

US 2012/0184419 A1 Jul. 19, 2012

(30) Foreign Application Priority Data

| | | |
|---|---|---|
| Jan. 18, 2011 | (CN) | 2011 2 0018921 U |
| Jul. 7, 2011 | (CN) | 2011 2 0241182 U |
| Aug. 10, 2011 | (CN) | 2011 2 0288498 U |

(51) Int. Cl.

| | |
|---|---|
| ***A63B 21/045*** | (2006.01) |
| ***A63B 21/02*** | (2006.01) |
| ***A63B 21/00*** | (2006.01) |
| ***A63B 23/035*** | (2006.01) |
| ***A63B 23/02*** | (2006.01) |

(52) U.S. Cl.

CPC ..... *A63B 21/025* (2013.01); *A63B 21/0004* (2013.01); *A63B 23/03516* (2013.01); *A63B 21/045* (2013.01); *A63B 23/0222* (2013.01); *A63B 21/1492* (2013.01)

USPC ..... 482/127

(58) Field of Classification Search

CPC ..... A63B 23/0211; A63B 21/0552; A63B 21/0421; A63B 21/0557; A63B 21/1492

USPC ..... 482/127, 140, 121

See application file for complete search history.

(56) References Cited

U.S. PATENT DOCUMENTS

| | | | | |
|---|---|---|---|---|
| 5,626,545 | A * | 5/1997 | Newman et al. | 482/127 |
| 5,743,830 | A * | 4/1998 | Ho | 482/44 |
| 6,024,679 | A * | 2/2000 | Castallanos et al. | 482/140 |
| 6,080,090 | A * | 6/2000 | Taylor et al. | 482/121 |
| 7,077,787 | B1 * | 7/2006 | Wiesman | 482/49 |
| 7,717,835 | B2 * | 5/2010 | Harding-Randle | 482/127 |
| 2002/0039953 | A1 * | 4/2002 | Spiel | 482/92 |
| 2003/0100415 | A1 * | 5/2003 | Augustine et al. | 482/140 |
| 2007/0027008 | A1 * | 2/2007 | Levinson et al. | 482/121 |
| 2007/0135281 | A1 * | 6/2007 | Liao | 482/140 |

* cited by examiner

*Primary Examiner* — Loan H Thanh
*Assistant Examiner* — Andrew S Lo
(74) *Attorney, Agent, or Firm* — Jacobson Holman Hershkovitz PLLC; Jiwen Chen

(57) ABSTRACT

A slimming machine, comprising U-shaped left and right arm tubes and resiliently retractable mechanisms that are attached to the two ends thereof, in which each resiliently retractable mechanism includes an inner joint cover, an outer joint cover and a torsion spring, left and right splice sleeves that are fixed on the respective inner and outer joint covers are connected with inner chambers of the joint covers, the outer joint cover can be rotationally mounted on the inner joint cover via a connecting shaft, the torsion spring is sheathed on the connecting shaft with one end disposed in the left splice sleeve and the other end in the right splice sleeve, and the left and right splice sleeves are fixed on the respective left and right arm tubes. Such structure is simple, reasonable, easy to operate, cost effective, and meanwhile it has excellent fitness effects.

11 Claims, 7 Drawing Sheets

SLIMMING MACHINE

The present application claims the priority of Chinese Patent Application No. 201120018921.2 filed Jan. 18, 2011; Chinese Patent Application No. 201120241182.3 filed Jul. 7, 2011, and Chinese Patent Application No. 201120288498.8 filed Aug. 10, 2011, which are hereby incorporated by reference.

FIELD OF THE INVENTION

The present invention relates to a type of fitness equipment, more particularly to a type of simple and practical multi-functional fitness equipment.

BACKGROUND OF THE INVENTION

Along with social development and progress, people's life quality is improving, but the population suffering from sub-health and obesity is also increasing due to work stress and lack of exercise. Moreover, most of the places for fitness are in the open air and they are dramatically affected by the weather, so that it is difficult for people to keep up with their schedule for exercise. Consequently, in order to meet people's needs, more and more types of indoor fitness equipment are developed and become increasingly popular. However, conventional fitness equipment has the following disadvantages: (1) they are complicated in structure and big in size, therefore large space and professional trainers are required. They are suitable for gyms not for home use; (2) they are high in price and unaffordable for ordinary families; (3) they only have a few functions. Consequently, many manufacturers and people have made development and trial production aiming to solve the above problems, but a satisfactory product is still unavailable.

SUMMARY OF THE INVENTION

In view of the above-described problems, it is an object of the present invention to overcome the disadvantages of conventional fitness equipment and provide a multi-functional slimming machine with simple and reasonable structure, excellent fitness effects, and meanwhile it is easy to operate and carry.

To achieved the above object, in accordance with the invention, there provided is a slimming machine, comprising U-shaped left and right arm tubes and resiliently retractable mechanisms that are attached to the two ends thereof, wherein each resiliently retractable mechanism includes an inner joint cover, an outer joint cover and a torsion spring, left and right splice sleeves that are fixed on the respective inner and outer joint covers are connected with inner chambers of the joint covers, the outer joint cover can be rotationally mounted on the inner joint cover via a connecting shaft, the torsion spring is sheathed on the connecting shaft with one end disposed in the left splice sleeve and the other end in the right splice sleeve, and the left and right splice sleeves are fixed on the respective left and right arm tubes.

In order to facilitate packaging, transportation, carrying, storage and safety application, in accordance with embodiment 1 of the invention, the left and right splice sleeves are hollow and fixedly connected with respective inner and outer joint covers via screws, on the left and right splice sleeves corresponding to the torsion spring are disposed with a torsion spring sleeve to form a whole part, the connection end of the torsion spring is disposed on the torsion spring sleeve, the left and right splice sleeves each includes a ball lock latch, on the left and right arm tubes are respectively disposed with a lock hole matching the ball lock latch, and the left and right splice sleeves are fixedly connected with respective left and right arm tubes by means of the engagement between the ball lock latch and the lock hole.

In order to facilitate packaging, transportation, carrying, storage and safety application, in accordance with embodiment 2 of the invention, the left and right splice sleeves are solid and fixedly connected with the respective inner and outer joint covers via screws, on the end surfaces of the left and right splice sleeves corresponding to the torsion spring are disposed with torsion spring sockets, the connection end of the torsion spring is disposed on the torsion spring socket and the other ends of the left and right splice sleeves are fixedly connected with respective left and right arm tubes via the screws.

For the purpose of the convenient assembly and reliable positioning, on the left and right splice sleeves are disposed with positioning slots matching the inner and outer joint covers.

For the purpose of the comfortable physical contact, on the left and right arm tubes are respectively sheathed with sponge covers.

For the purpose of the convenient application, on the left arm tube is disposed with pulling bands.

The slimming machine provided by the invention has the following advantages or effects compared with the prior art: 1) the left and right arm tubes can be contacted with different parts of the body and thus can be opened and closed by an inward squeezing motion, so that the legs, arms, waists, chests and the like can be fully exercised through different postures; and 2) when the machine is not in use, users can operate the ball lock latch or the screws disposed on the left and right splice sleeves to easily remove the left and right arm tubes from the resiliently retractable mechanism, so that the machine can be easily packed, transported, carried and stored.

Figure 1:
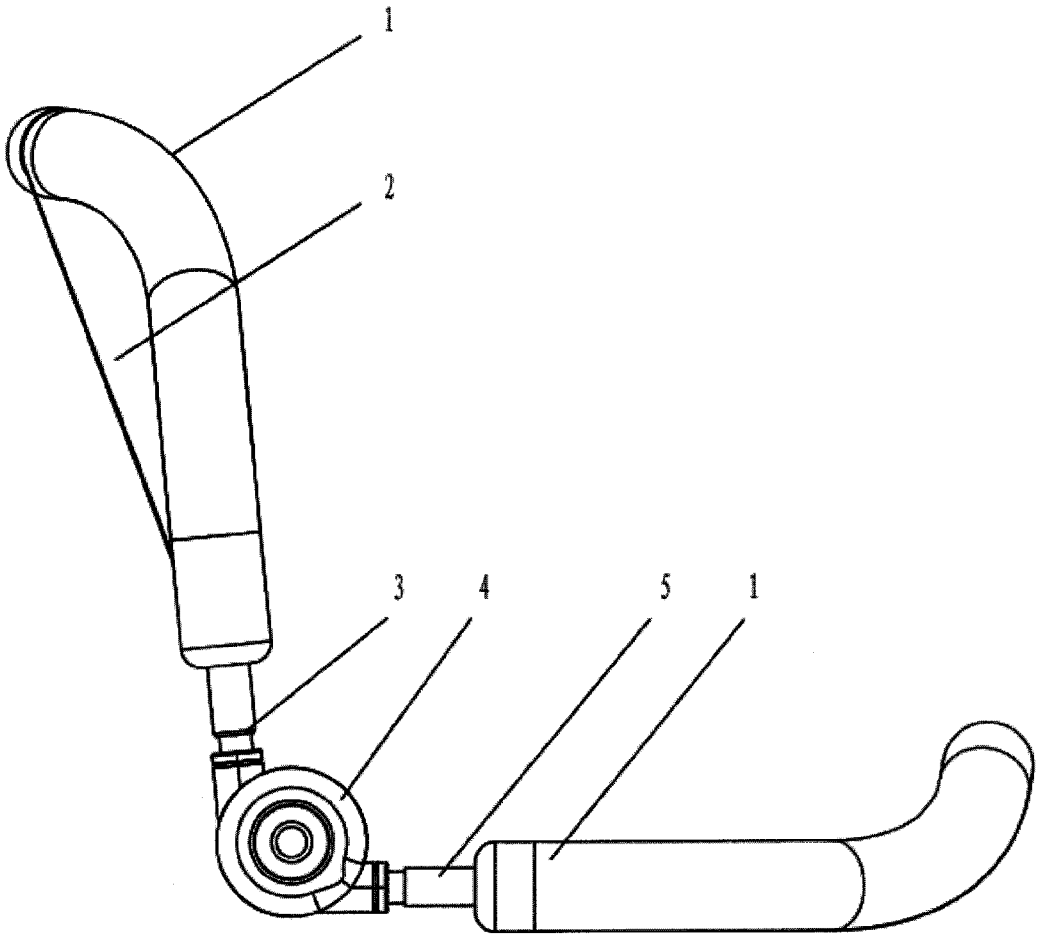
FIG. 1 is a front view of a slimming machine of the present invention.

The slimming machine, in accordance with the present invention, comprises sponge covers 1, pulling bands 2, a left arm tube 3, resiliently retractable mechanisms 4, a right arm tube 5, left splice sleeves 41, torsion springs 42, outer joint covers 43, right splice sleeves 44, inner joint covers 45, ball lock latches 46, connecting shafts 47, screws 48, positioning slots 49, and lock holes 51.

DETAILED DESCRIPTION OF THE EMBODIMENTS

Figure 2:
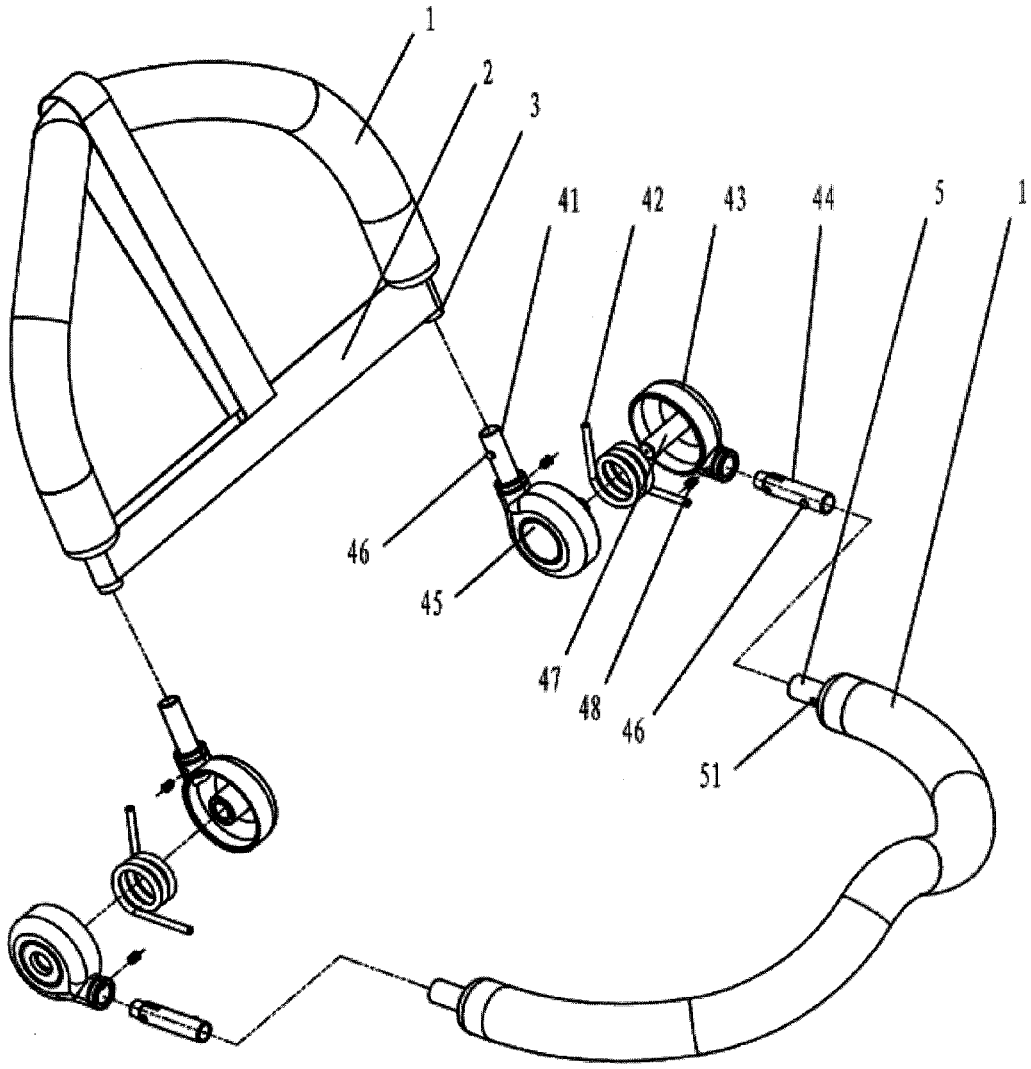
FIG. 2 is an exploded schematic diagram of the slimming machine in accordance with embodiment 1 of the present invention.
Figure 4:
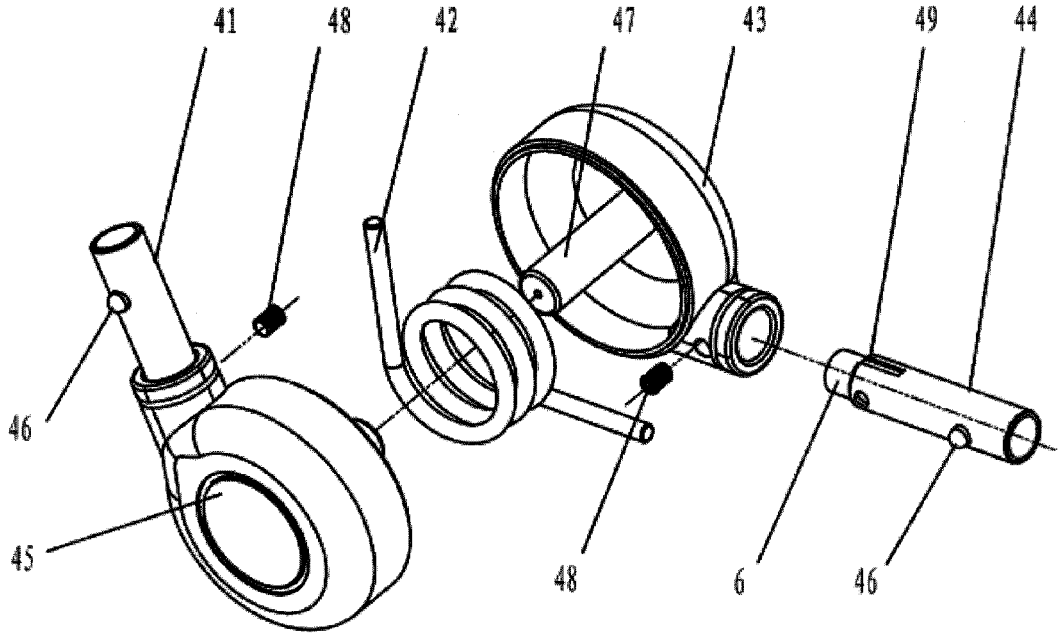
FIG. 4 is an enlarged view of a resiliently retractable mechanism in accordance with embodiment 1 of the present invention.

FIGS. 1, 2 and 4 show the embodiment 1 of the slimming machine, comprising U-shaped left and right arm tubes 3, 5 and resiliently retractable mechanisms 4 that are attached to the two ends of the left and right arm tubes 3, 5, wherein the left and right arm tubes 3, 5 are respectively sheathed with sponge covers 1, on the left arm tube 3 is disposed with pulling bands 2. Each resiliently retractable mechanism 4 includes an inner joint cover 45, an outer joint cover 43 and a torsion spring 42, left and right splice sleeves 41, 44 that are fixed on the respective inner and outer joint covers 45, 43 are connected with inner chambers of the joint covers, the outer joint cover 43 can be rotationally mounted on the inner joint cover 45 via a connecting shaft 47, the torsion spring 42 is sheathed on the connecting shaft 47 with one end disposed in the left splice sleeve 41 and the other end in the right splice sleeve 44. When the torsion spring 42 is under squeeze, the inner and outer joint covers 45, 43 are unlikely to be damaged. Moreover, the left and right splice sleeves 41, 44 are fixed on the respective left and right arm tubes 3, 5.

The left and right splice sleeves 41, 44 are hollow and fixedly connected with respective inner and outer joint covers 45, 43 via screws 48, on the left and right splice sleeves 41, 44 corresponding to the torsion spring 42 are disposed with a torsion spring sleeve 6 to form a whole part, the connection end of the torsion spring 42 is disposed on the torsion spring sleeve 6, the left and right splice sleeves 41, 44 each includes a ball lock latch 46, on the left and right arm tubes 3, 5 are respectively disposed with a lock hole 51 matching the ball lock latch 46, the left and right splice sleeves 41, 44 are fixedly connected with respective left and right arm tubes 3, 5 by means of the engagement between the ball lock latch 46 and the lock hole 51, and the left and right arm tubes 3, 5 can be easily removed. For the purpose of the convenient assembly and reliable positioning, on the left and right splice sleeves 41, 44 are disposed with positioning slots 49 matching the inner and outer joint covers 45, 43.

As shown in FIGS. 2 and 4, the screws 48 connecting the left and right splice sleeves 41, 44 together with the inner and outer joint covers 45, 43 pass through the torsion spring sleeve 6 and press on the connection end of the torsion spring 42 so as to connect the torsion spring 42, the left and right splice sleeves 41, 44 as well as the inner and outer joint covers 45, 43.

Figure 3:
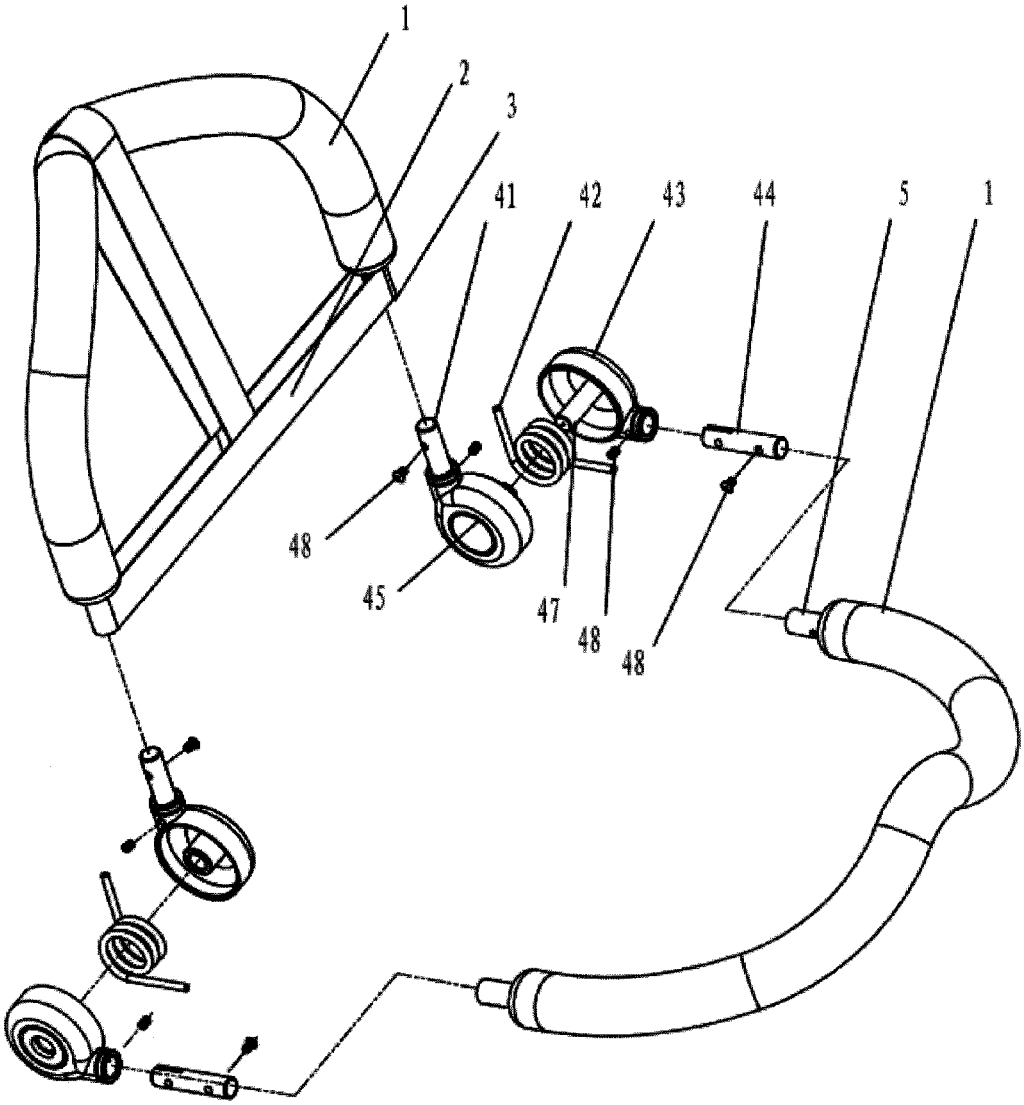
FIG. 3 is an exploded schematic diagram of the slimming machine in accordance with embodiment 2 of the present invention.
Figure 5:
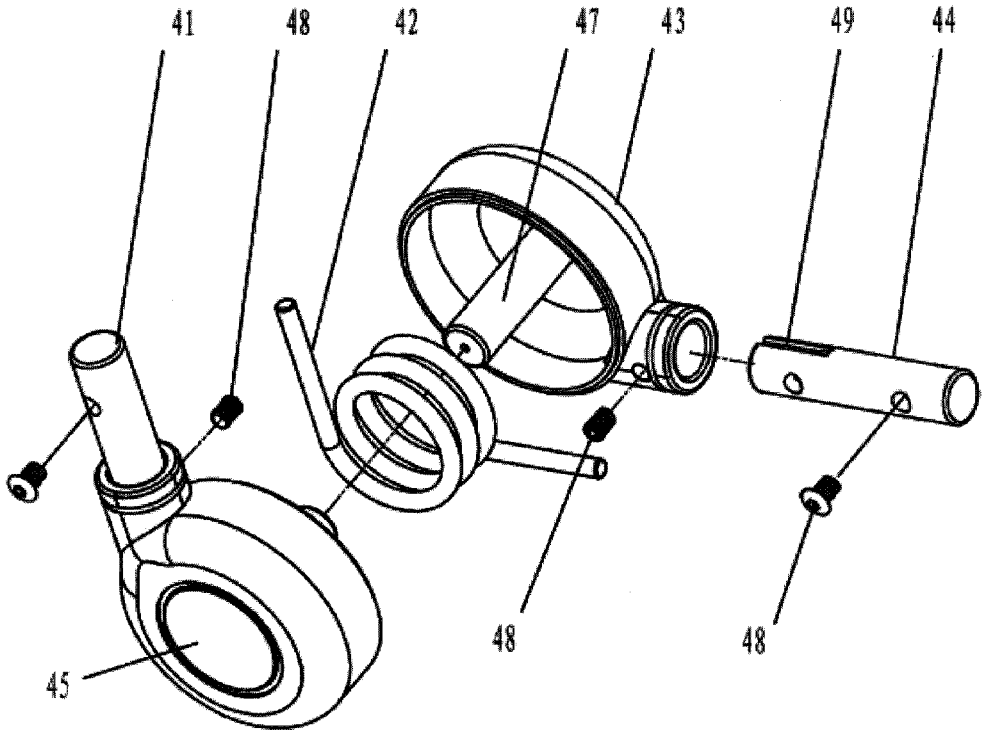
FIG. 5 is an enlarged view of the resiliently retractable mechanism in accordance with embodiment 2 of the present invention.

FIGS. 3 and 5 show the embodiment 2 of the invention, which is characterized in that the left and right splice sleeves 41, 44 are solid, on the end surfaces of the left and right splice sleeves 41, 44 corresponding to the torsion spring 42 are disposed with torsion spring sockets, the connection end of the torsion spring 42 is disposed on the torsion spring socket and the other ends of the left and right splice sleeves 41, 44 are fixedly connected with respective left and right arm tubes 3, 5 via the screws 48. The left and right splice sleeves 41, 44 are also fixedly connected with the inner and outer joint covers 45, 43 via the screws 48.

Figure 6:
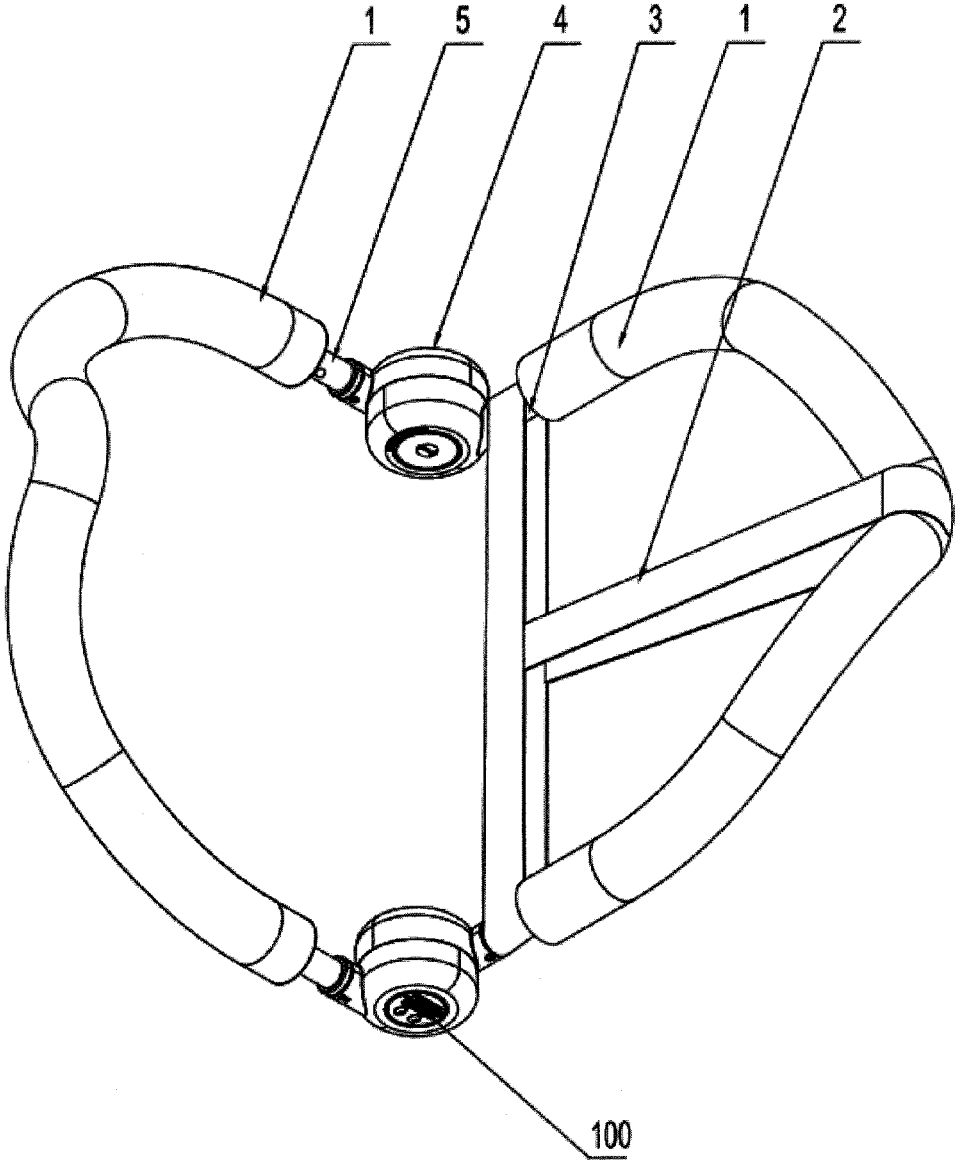
FIG. 6 is a schematic diagram of the slimming machine in accordance with embodiment 3 of the present invention.
Figure 7:
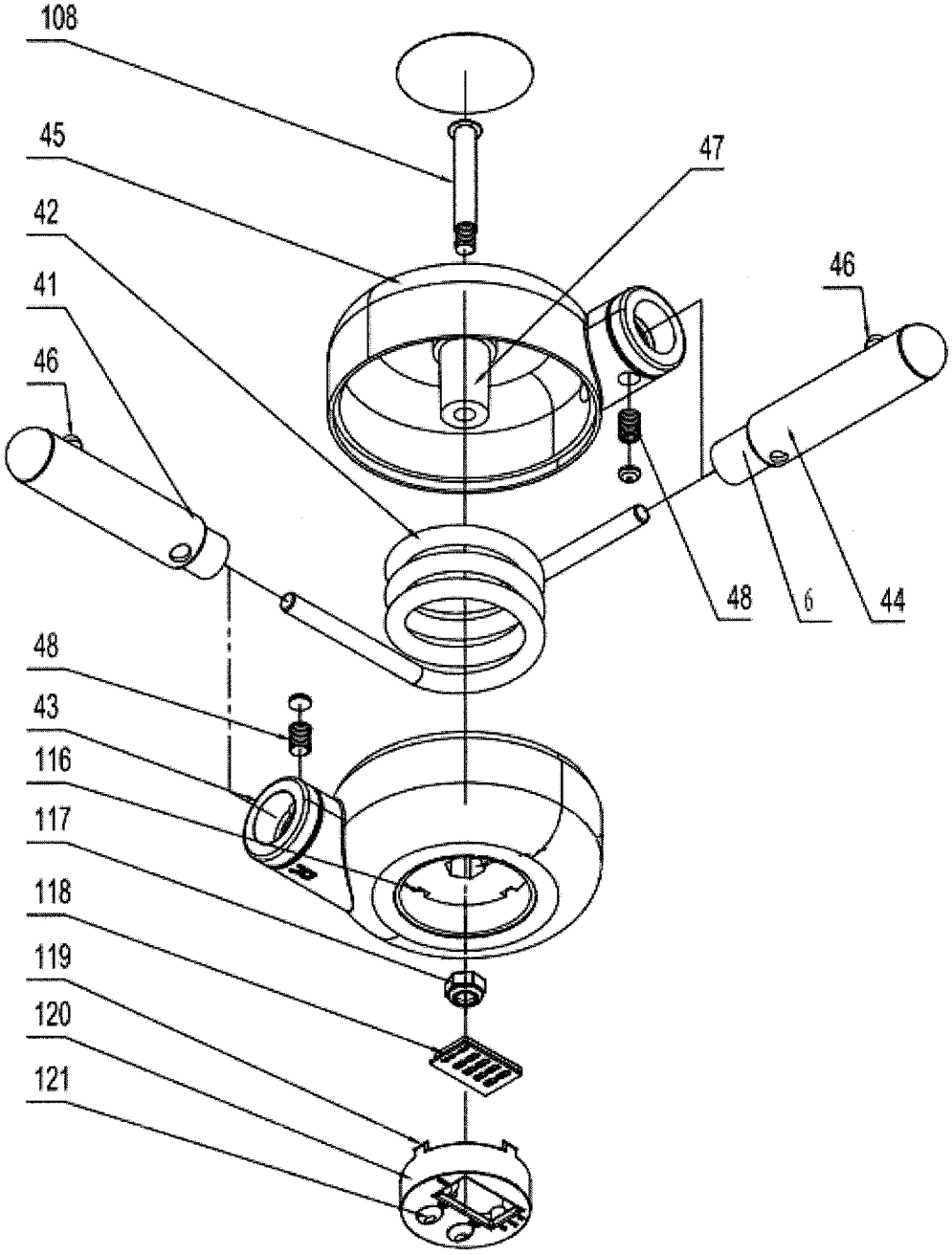
FIG. 7 is an enlarged view of the resiliently retractable mechanism in accordance with embodiment 3 of the present invention.

It should be noted that the other descriptions of the slimming machine in the embodiment 2 are the same as those described in the embodiment 1. If the numbers marked in FIGS. 3 and 5 are the same as those in FIGS. 1, 2 and 4, they represent the same meaning FIGS. 6 and 7 show the embodiment 3 of the invention based on the embodiment 1, in which on one of the outer joint covers 43 is disposed with a multi-functional digital meter 100.

The multi-functional digital meter 100 includes a support 120, functional buttons 121, a control circuit and a digital display 118, in which the functional buttons 121, the control circuit and the digital display 118 are disposed on the support 120, on the support 120 is disposed with a buckle 119, on the end surface of the outer joint cover is disposed with a chamber corresponding to the support 120, a buckle seat 116 matching the buckle 119 is disposed in the chamber, the support 120 is disposed in the chamber of the outer joint cover and fixed on the buckle seat 116 via the buckle 119. Consequently, when fitness lovers intend to do exercises, they only need to press the functional buttons to start the multi-functional digital meter, which will automatically start timing, count times, display exercise time and numbers. The fitness lovers will easily know how much exercise they have taken every time.

The slimming machine, in accordance with embodiment 3, also comprises a connecting rod 108, which passes through the connecting shaft 47 to connect a nut 117 outside the inner or outer joint cover by means of the threaded connection.

It should be noted that the other descriptions of the slimming machine in the embodiment 3 are the same as those described in the embodiment 1. If the numbers marked in FIGS. 6 and 7 are the same as those in FIGS. 1, 2 and 4, they represent the same meaning

The invention claimed is:

1. A slimming machine comprising U-shaped left and right arm tubes and resiliently retractable mechanisms that are respectively attached to two ends of the left and right arm tubes, wherein each resiliently retractable mechanism includes an inner joint cover, an outer joint cover and a torsion spring, left and right splice sleeves that are fixed on the respective inner and outer joint covers are connected with inner chambers of the joint covers, the outer joint cover can be rotationally mounted on the inner joint cover via a connecting shaft, the torsion spring is sheathed on the connecting shaft with one end disposed in the left splice sleeve and the other end in the right splice sleeve, and the left and right splice sleeves are fixed on the respective left and right arm tubes; wherein on one of the outer joint covers is disposed with a multi-functional digital meter; and wherein said multi-functional digital meter includes a support, functional buttons, a control circuit and a digital display, in which the functional buttons, the control circuit and the digital display are disposed on the support, on the support is disposed with a buckle, on the end surface of the outer joint cover is disposed with a chamber corresponding to the support, a buckle seat matching the buckle is disposed in the chamber, the support is disposed in the chamber of the outer joint cover and fixed on the buckle seat via the buckle.

2. The slimming machine according to claim 1, wherein left and right splice sleeves are hollow and fixedly connected with respective inner and outer joint covers via screws, on the left and right splice sleeves corresponding to the torsion spring are disposed with a torsion spring sleeve to form a whole part, a connection end of the torsion spring is disposed on the torsion spring sleeve, the left and right splice sleeves each includes a ball lock latch, on the left and right arm tubes are respectively disposed with a lock hole matching the ball lock latch, and the left and right splice sleeves are fixedly connected with respective left and right arm tubes by means of the engagement between the ball lock latch and the lock hole.

3. The slimming machine according to claim 1, wherein the left and right splice sleeves are solid and fixedly connected with the respective inner and outer joint covers via the screws, on the end surfaces of the left and right splice sleeves corresponding to the torsion spring are disposed with torsion spring sockets, the connection end of the torsion spring is disposed on the torsion spring socket and the other ends of the left and right splice sleeves are fixedly connected with respective left and right arm tubes via the screws.

4. The slimming machine according to claim 2, wherein on the left and right splice sleeves are disposed with positioning slots matching the inner and outer joint covers.

5. The slimming machine according to claim 4, wherein on the left and right arm tubes are respectively sheathed with sponge covers.

6. The slimming machine according to claim 5, wherein on the left arm tube is disposed with pulling bands.

7. The slimming machine according to claim 2, wherein the screws connecting the left and right splice sleeves together with the respective inner and outer joint covers pass through the torsion spring sleeve and press on the connection end of the torsion spring so as to connect the torsion spring, the left and right splice sleeves as well as the inner and outer joint covers.

8. The slimming machine according to claim 1, wherein the slimming machine also comprises a connecting rod, which passes through the connecting shaft to connect a nut outside the inner or outer joint cover by means of threaded connection.

9. The slimming machine according to claim 3, wherein on the left and right splice sleeves are disposed with positioning slots matching the inner and outer joint covers.

10. The slimming machine according to claim 3, wherein the screws connecting the left and right splice sleeves together with the respective inner and outer joint covers pass through the torsion spring sleeve and press on the connection end of the torsion spring so as to connect the torsion spring, the left and right splice sleeves as well as the inner and outer joint covers.

11. The slimming machine according to claim 1, wherein the slimming machine also comprises a connecting rod, which passes through the connecting shaft to connect a nut outside the inner or outer joint cover by means of the threaded connection.

* * * * *